US012729920B2

(12) United States Patent
Onaka et al.

(10) Patent No.: US 12,729,920 B2
(45) Date of Patent: Sep. 8, 2026

(54) HEAT EXCHANGER, REFRIGERATION CYCLE APPARATUS, AND METHOD FOR MANUFACTURING HEAT EXCHANGER

(71) Applicant: Mitsubishi Electric Corporation, Tokyo (JP)

(72) Inventors: Yoji Onaka, Tokyo (JP); Rihito Adachi, Tokyo (JP); Nanami Kishida, Tokyo (JP); Taisaku Gomyo, Tokyo (JP); Tetsuji Saikusa, Tokyo (JP); Takashi Nakajima, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 161 days.

(21) Appl. No.: 18/573,436

(22) PCT Filed: Jun. 29, 2021

(86) PCT No.: PCT/JP2021/024516

§ 371 (c)(1),
(2) Date: Dec. 22, 2023

(87) PCT Pub. No.: WO2023/275978

PCT Pub. Date: Jan. 5, 2023

(65) Prior Publication Data

US 2024/0302114 A1 Sep. 12, 2024

(51) Int. Cl.
*F28F 17/00* (2006.01)
*F28D 1/053* (2006.01)
(Continued)

(52) U.S. Cl.
CPC ..... *F28F 17/005* (2013.01); *F28D 1/05383* (2013.01); *F28F 1/325* (2013.01); *F28D 2021/0068* (2013.01)

(58) Field of Classification Search
CPC ..... F28D 1/05383; F28F 17/005
See application file for complete search history.

(56) References Cited

U.S. PATENT DOCUMENTS 4,615,384 A * 10/1986 Shimada ..... F28F 1/128 165/181
5,033,540 A 7/1991 Tategami et al.
(Continued)

FOREIGN PATENT DOCUMENTS

CN 1477365 A 2/2004
EP 1103316 A2 * 5/2001 ..... B21D 53/02
(Continued)

OTHER PUBLICATIONS

Extended European Search Report dated Jul. 24, 2024 issued in corresponding European patent application No. 21948287.4 (7 pages).
(Continued)

*Primary Examiner* — Devon Lane
(74) *Attorney, Agent, or Firm* — XSENSUS LLP

(57) ABSTRACT

A heat exchanger includes a plurality of flat heat-transfer tubes; and a corrugated fin provided between each adjacent two of the plurality of flat heat-transfer tubes. The corrugated fin is joined to the outer lateral walls of each adjacent two of the plurality of flat heat-transfer tubes at apexes of the wavy shape. The corrugated fin includes fins connecting the apexes and being side by side in an axial direction of the plurality of flat heat-transfer tubes. The fin has a plurality of heat-transfer promoters each having a transfer-promoting projection projecting from a surface of the fin; and an open part provided in the fin. The fin includes, between the plurality of heat-transfer promoters, frost-growing areas
(Continued)

each having a through-hole continuous with the open part of a corresponding one of the plurality of heat-transfer promoters.

15 Claims, 16 Drawing Sheets

(51) Int. Cl.
*F28F 1/32* (2006.01)
*F28D 21/00* (2006.01)

(56) References Cited

U.S. PATENT DOCUMENTS

| | | | | |
|---|---|---|---|---|
| 5,706,886 | A * | 1/1998 | Kim | F28F 1/325 29/890.047 |
| 6,401,809 | B1 * | 6/2002 | Zhang | F28F 1/128 165/146 |
| 6,883,598 | B2 * | 4/2005 | Sandberg | F28F 1/128 165/181 |
| 7,080,682 | B2 * | 7/2006 | Ko | F28F 1/128 165/181 |
| 9,803,935 | B2 * | 10/2017 | Kamada | F25D 21/12 |
| 2004/0035563 | A1 * | 2/2004 | Ko | F28D 1/05366 62/272 |
| 2004/0206484 | A1 * | 10/2004 | Shimoya | F28F 1/128 165/181 |
| 2006/0237173 | A1 | 10/2006 | Okura et al. | |
| 2010/0243226 | A1 * | 9/2010 | Huazhao | F28F 1/128 165/185 |
| 2017/0082381 | A1 | 3/2017 | Sugimura et al. | |
| 2022/0341682 | A1 * | 10/2022 | Asai | B21D 53/022 |

FOREIGN PATENT DOCUMENTS

| | | | | |
|---|---|---|---|---|
| JP | S56-066695 | A | 6/1981 | |
| JP | 59189292 | A * | 4/1983 | |
| JP | H03-177795 | A | 8/1991 | |
| JP | H09-061081 | A | 3/1997 | |
| JP | H10220977 | A | 8/1998 | |
| JP | 2004-085168 | A | 3/2004 | |
| JP | 2004-101074 | A | 4/2004 | |
| JP | 4683987 | B2 | 5/2011 | |
| JP | 2013250016 | A | 12/2013 | |
| JP | 2015-183908 | A | 10/2015 | |
| JP | 2019-045033 | A | 3/2019 | |
| KR | 20060083487 | A | 7/2006 | |
| WO | WO-2014000761 | A1 * | 1/2014 | B31D 3/0246 |
| WO | 2021/095538 | A1 | 5/2021 | |

OTHER PUBLICATIONS

International Search Report and Written Opinion mailed on Sep. 21, 2021, received for PCT Application PCT/JP2021/024516, filed on Jun. 29, 2021, 08 pages including English Translation.

Office Action issued Oct. 22, 2024 in Japanese Patent Application No. 2023-531187, 9 pages.

Office Action dated May 29, 2026 issued in corresponding CN patent application No. 202180099740.3 (18 pages; with English translation).

* cited by examiner

HEAT EXCHANGER, REFRIGERATION CYCLE APPARATUS, AND METHOD FOR MANUFACTURING HEAT EXCHANGER

CROSS-REFERENCE TO RELATED APPLICATION

This application is a national stage application, filed under 35 U.S.C. § 371, of International Patent Application No. PCT/JP2021/024516, filed Jun. 29, 2021, the entire contents of which are incorporated herein by reference.

TECHNICAL FIELD

The present disclosure relates to a heat exchanger configured as a combination of corrugated fins and flat heat-transfer tubes, and also relates to a refrigeration cycle apparatus and a method for manufacturing the heat exchanger.

BACKGROUND ART

Hitherto, for example, heat exchangers of a corrugated-fin-tube type have been widely known in which a corrugated fin is provided between flat walls of each adjacent two of a plurality of flat heat-transfer tubes, the plurality of flat heat-transfer tubes connecting a pair of headers through which refrigerant is made to flow. A gas flow is made to pass through between the flat heat-transfer tubes provided with the corrugated fins. In such a heat exchanger, the surface temperature of at least one of the set of flat heat-transfer tubes and the set of corrugated fins may drop to the freezing point of water or below. If the temperature of a surface drops, moisture in the air near the surface is first condensed into water and is then frozen into ice at the freezing point of water or below. In view of such circumstances, a heat exchanger includes fins having slits, or air gaps, so that water condensed on the surfaces of the fins are drained through the slits (see Patent Literature 1, for example).

CITATION LIST

Patent Literature

Patent Literature 1: Japanese Unexamined Patent Application Publication No. 2015-183908

SUMMARY OF INVENTION

Technical Problem

The known heat exchanger has slits configured to drain water condensed on the surfaces of the corrugated fins. To make the slits, a plate that is to serve as a corrugated fin is partially cut, whereby incisions piercing through the plate are provided. Since such slits have small widths, any water or frost built up in the slits is difficult to drain. The built-up water or frost acts as a resistance to the air passing through the heat exchanger and lowers the heat-transfer performance of the corrugated fin.

The present disclosure is to solve the above problem and to provide a heat exchanger, a refrigeration cycle apparatus, and a method for manufacturing a heat exchanger in each of which corrugated fins are configured to exert improved drainability and improved frost resistance.

Solution to Problem

A heat exchanger according to an embodiment of the present disclosure includes a plurality of flat heat-transfer tubes arranged side by side such that an outer lateral wall of each of the flat heat-transfer tubes faces an outer lateral wall of an adjacent one of the flat heat-transfer tubes; and a corrugated fin having a wavy shape and provided between each adjacent two of the plurality of flat heat-transfer tubes. The corrugated fin is joined to the outer lateral walls of each adjacent two of the plurality of flat heat-transfer tubes at apexes of the wavy shape. The corrugated fin includes fins connecting the apexes and being side by side in an axial direction of the plurality of flat heat-transfer tubes. Defining a direction in which the plurality of flat heat-transfer tubes are side by side as a side-by-side direction and a longitudinal direction of a cross section of each of the plurality of flat heat-transfer tubes as a depthwise direction, the fin has a plurality of heat-transfer promoters arranged side by side in the depthwise direction. The plurality of heat-transfer promoters each have a transfer-promoting projection projecting from a surface of the fin; and an open part provided in the fin. The fine has, between the plurality of heat-transfer promoters, frost-growing areas whose width is defined in the depthwise direction. The frost-growing areas each have a through-hole continuous with the open part of a corresponding one of the plurality of heat-transfer promoters.

A refrigeration cycle apparatus according to another embodiment of the present disclosure includes the above heat exchanger.

A method for manufacturing a heat exchanger according to still another embodiment of the present disclosure is a method in which the above heat exchanger is manufactured. The method includes forming the corrugated fin from a flat plate; and joining the apexes of the corrugated fin to the flat heat-transfer tubes. The forming of the corrugated fin includes punching the through-holes in the plate and forming the heat-transfer promoters by deforming at least one of flat portions at edges of each of the through-holes such that the at least one flat portion is moved in a direction perpendicular to a surface of the plate; folding the plate having the through-holes and the heat-transfer promoters into a wavy shape; and cutting the plate into pieces each having a predetermined length, the cutting being performed after the folding.

Advantageous Effects of Invention

According to each of the above embodiments of the present disclosure, the corrugated fin of the heat exchanger is configured to drain water from upper ones of the fins to lower ones of the fins through the frost-growing areas adjoining the heat-transfer promoters. Therefore, water condensed on the fins is less likely to build up and to be frozen. Consequently, the heat-transfer performance of the corrugated fin is further improved. Moreover, since spaces for frost to grow are provided, the time to betaken for the frost to close airflow passages between the fins is extended. Thus, the frost resistance is improved.

DESCRIPTION OF EMBODIMENTS

Figure 1:
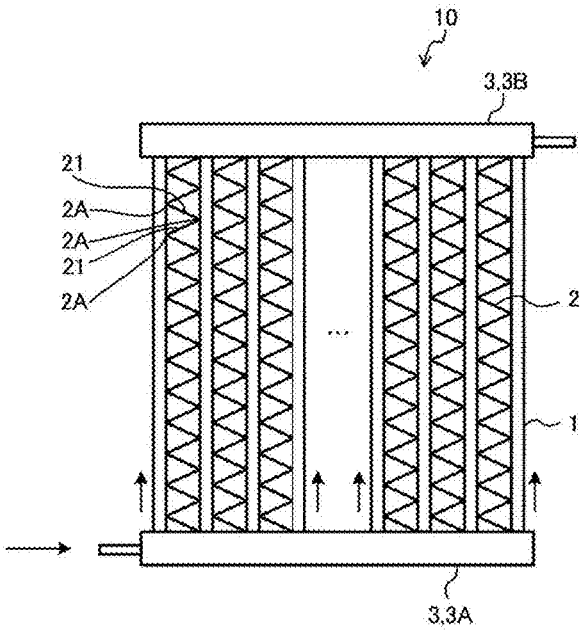
FIG. 1 is a front view of a heat exchanger 10 according to Embodiment 1.

A heat exchanger, a refrigeration cycle apparatus, and a method for manufacturing a heat exchanger according to embodiments will now be described with reference to the accompanying drawings and other materials. In the drawings to be referred to below, the same reference signs denote the same or equivalent elements, which applies throughout the following description of embodiments. The forms of any elements described throughout this specification are only exemplary and are not limited thereto. In particular, combinations of any elements are not limited to combinations of elements described in a single embodiment. Any elements described in one embodiment may be applied to another embodiment. In the following description, the upper side and the lower side in the drawings are referred to as "the upper side" and "the lower side", respectively. While terms describing directions (such as "right", "left", "front", and "rear") are used as appropriate for ease of understanding, such terms are only explanatory and do not limit the directions. Whether the humidity or the temperature is high or low is not determined on the basis of any absolute values and is determined on the basis of relative values of factors such as the conditions and behaviors of relevant devices and other elements. The elements illustrated in the drawings may be not to scale.

Embodiment 1

FIG. 1 is a front view of a heat exchanger 10 according to Embodiment 1. The heat exchanger 10 according to Embodiment 1 is a corrugated-fin-tube heat exchanger having a parallel-pipe configuration. The heat exchanger 10 includes a plurality of flat heat-transfer tubes 1, a plurality of corrugated fins 2, and a pair of headers 3. The axes of the flat heat-transfer tubes 1 extend in the top-bottom direction. The headers 3 are a header 3A and a header 3B, which are located below and above, respectively, the plurality of flat heat-transfer tubes 1. Hereinafter, the top-bottom direction in FIG. 1 is referred to as the tube-axis direction, and the left-right direction in FIG. 1 is referred to as the side-by-side direction. Furthermore, a direction perpendicular to the plane of the page in FIG. 1 is referred to as the depthwise direction. The depthwise direction coincides with the direction in which air flows through the heat exchanger 10. In Embodiment 1, the axes of the plurality of flat heat-transfer tubes 1 extend in the direction of gravity, that is, the heightwise direction. The axes do not necessarily need to extend parallel to the direction of gravity and may be oblique to the direction of gravity.

Heat Exchanger 10

The headers 3A and 3B are each connected by a pipe to another device included in a refrigeration cycle apparatus. The headers 3A and 3B are each a tube configured to receive and discharge refrigerant, which is a fluid serving as a medium for heat exchange. The headers 3A and 3B are also configured to split the refrigerant into refrigerant portions or to merge the refrigerant portions. Between the two headers 3A and 3B, the plurality of flat heat-transfer tubes 1 are arranged such that the axes thereof are perpendicular to the headers 3 and parallel to one another. In the heat exchanger 10 according to Embodiment 1, the two headers 3A and 3B are spaced apart from each other in the top-bottom direction. In Embodiment 1, the header 3A is located on the lower side for liquid refrigerant to flow through, whereas the header 3B is located on the upper side for gas refrigerant to flow through. Refrigerant flows into the lower header 3A, where the refrigerant is split into refrigerant portions flowing into the respective flat heat-transfer tubes 1. The split refrigerant portions merge together at the upper header 3B, through which the merged refrigerant is discharged from the heat exchanger 10.

Refrigeration Cycle Apparatus

Figure 2:
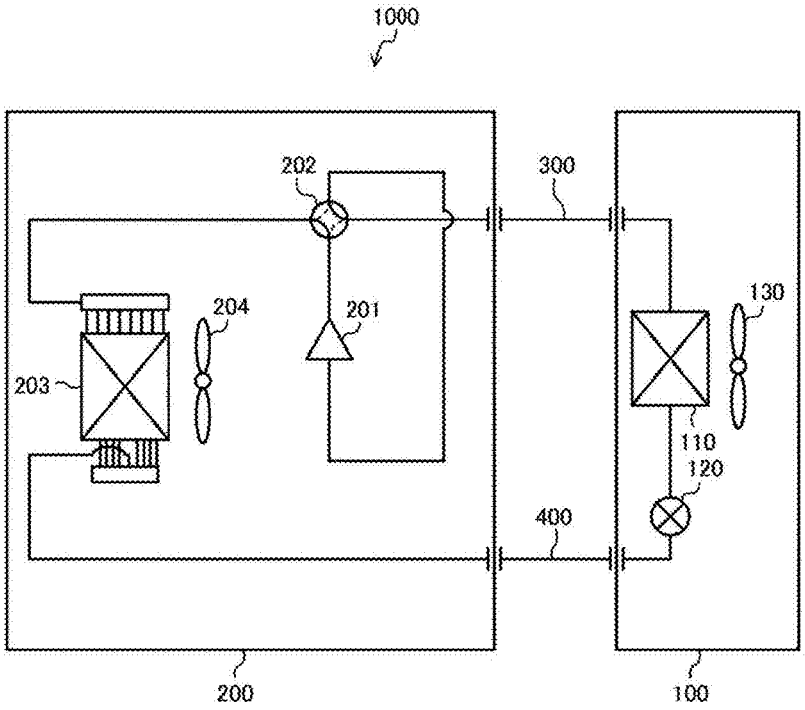
FIG. 2 illustrates a refrigeration cycle apparatus according to Embodiment 1.

FIG. 2 illustrates a refrigeration cycle apparatus according to Embodiment 1. In Embodiment 1, an air-conditioning apparatus 1000 will be described as an exemplary refrigeration cycle apparatus. The air-conditioning apparatus 1000 illustrated in FIG. 2 employs the heat exchanger 10 as an outdoor heat exchanger 203. However, the use of the heat exchanger 10 is not limited to the outdoor heat exchanger 203 and may be an indoor heat exchanger 110. Moreover, the heat exchanger 10 may be applied to both the outdoor heat exchanger 203 and the indoor heat exchanger 110.

As illustrated in FIG. 2, the air-conditioning apparatus 1000 includes an outdoor unit 200 and an indoor unit 100, which are connected to each other by a gas refrigerant pipe 300 and a liquid refrigerant pipe 400 into a refrigerant circuit. The outdoor unit 200 includes a compressor 201, a four-way valve 202, the outdoor heat exchanger 203, and an outdoor fan 204. Embodiment 1 relates to an air-conditioning apparatus including one outdoor unit 200 and one indoor unit 100 that are connected to each other by pipes.

The compressor 201 is configured to compress refrigerant sucked thereinto and to discharge the compressed refrigerant. The compressor 201, which is not particularly limited, has a capacity that is changeable by changing the operating frequency thereof as appropriate with the use of, for example, an inverter circuit. The four-way valve 202 is configured to switch the flow of the refrigerant between, for example, a flow for a cooling operation and a flow for a heating operation.

The outdoor heat exchanger 203 causes the refrigerant to exchange heat with outdoor air. Specifically, in the heating operation, the outdoor heat exchanger 203 serves as an evaporator and evaporates the refrigerant into gas. In the cooling operation, the outdoor heat exchanger 203 serves as a condenser and condenses the refrigerant into liquid. The outdoor fan 204 sends outdoor air to the outdoor heat exchanger 203, thereby promoting the heat exchange in the outdoor heat exchanger 203.

The indoor unit 100 includes the indoor heat exchanger 110, an expansion valve 120, and an indoor fan 130. The expansion valve 120 is a device such as a throttle device and is configured to expand the refrigerant by decompressing the refrigerant. If the expansion valve 120 is an electronic expansion valve, for example, the opening degree of the expansion valve 120 is adjusted on the basis of an instruction issued by a controller (not illustrated) or any other device. The indoor heat exchanger 110 causes the refrigerant to exchange heat with indoor air, which is the air in an indoor air-conditioning target space. Specifically, in the heating operation, the indoor heat exchanger 110 serves as a condenser and condenses the refrigerant into liquid. In the cooling operation, the indoor heat exchanger 110 serves as an evaporator and evaporates the refrigerant into gas. The indoor fan 130 causes the indoor air to flow through the indoor heat exchanger 110 and thus supplies to the indoor space the air having flowed through the indoor heat exchanger 110.

Now, how the above devices included in the air-conditioning apparatus 1000 operate will be described on the basis of the flow of the refrigerant. First, how the devices in the refrigerant circuit operate in the heating operation will be described on the basis of the flow of the refrigerant. The refrigerant compressed by the compressor 201 into high-temperature, high-pressure gas refrigerant is discharged from the compressor 201, flows through the four-way valve 202, and flows into the indoor heat exchanger 110. That is, in the heating operation, the refrigerant flows along paths in the four-way valve 202 that are illustrated by dotted lines in FIG. 2. While the gas refrigerant is flowing through the indoor heat exchanger 110, the gas refrigerant exchanges heat with, for example, the air in the air-conditioning target space, thereby being condensed into liquid. The condensed liquid refrigerant flows through the expansion valve 120. When the refrigerant flows through the expansion valve 120, the refrigerant is decompressed. The refrigerant decompressed by the expansion valve 120 into two-phase gas-liquid flows into the outdoor heat exchanger 203. In the outdoor heat exchanger 203, the refrigerant exchanges heat with the outdoor air supplied from the outdoor fan 204, thereby being evaporated into gas. The gas refrigerant then flows through the four-way valve 202 and is sucked into the compressor 201 again. The refrigerant is thus made to circulate through the air-conditioning apparatus and is used for air-conditioning of heating.

The cooling operation is as follows. The refrigerant compressed by the compressor 201 into high-temperature, high-pressure gas refrigerant is discharged from the compressor 201, flows through the four-way valve 202, and flows into the outdoor heat exchanger 203. That is, in the cooling operation, the refrigerant flows along paths in the four-way valve 202 that are illustrated by solid lines in FIG. 2. The gas refrigerant flowing through the outdoor air 203 exchanges heat with the outdoor air supplied from the outdoor fan 204, thereby being condensed into liquid. The liquid refrigerant then flows through the expansion valve 120. When the refrigerant flows through the expansion valve 120, the refrigerant is decompressed. The refrigerant decompressed by the expansion valve 120 into two-phase gas-liquid flows into the indoor heat exchanger 110. In the indoor heat exchanger 110, the two-phase gas-liquid refrigerant exchanges heat with, for example, the air in the air-conditioning target space, thereby being evaporated into gas. The gas refrigerant flows through the four-way valve 202 and is sucked into the compressor 201 again. The refrigerant is thus made to circulate through the air-conditioning apparatus and is used for air-conditioning of cooling.

Flat Heat-Transfer Tubes 1

Figure 3:
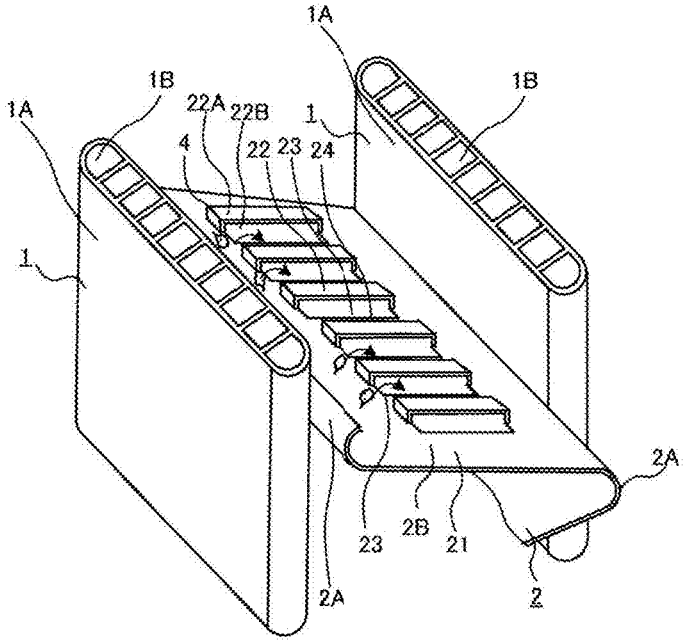
FIG. 3 is an enlarged perspective view of the heat exchanger 10 according to Embodiment 1, illustrating a configuration including a plurality of flat heat-transfer tubes 1 and a corrugated fin 2.

FIG. 3 is an enlarged perspective view of the heat exchanger 10 according to Embodiment 1, illustrating a configuration including the plurality of flat heat-transfer tubes 1 and the corrugated fins 2. Specifically, FIG. 3 illustrates some of the flat heat-transfer tubes 1 with cross sections thereof taken perpendicularly to the axes thereof. FIG. 3 also illustrates a part of one corrugated fin 2, which has a fanfolded shape, for description of fins 21 thereof. Each flat heat-transfer tube 1 has a flat shape in a cross section perpendicular to the axis thereof and is oriented such that the long-side direction of the flat cross section coincides with the depthwise direction that coincides with the direction of the airflow. The flat heat-transfer tube 1 has outer lateral walls 1A, which each extend flat in the long-side direction of the cross section of the flat heat-transfer tube 1. The flat heat-transfer tube 1 further has other lateral walls extending in the short-side direction orthogonal to the long-side direction. The other lateral walls are the end walls of the flat heat-transfer tube 1 that are on the respective sides in the long-side direction of the cross section. The end walls are curved.

The flat heat-transfer tube 1 is a multi-passage flat heat-transfer tube having a plurality of holes 1B, which serve as flow passages for the refrigerant. In Embodiment 1, the holes 1B of the flat heat-transfer tube 1 each serve as a flow passage that connects the headers 3A and 3B to each other. Accordingly, the holes 1B extend in the heightwise direction. The plurality of flat heat-transfer tubes 1 are arranged side by side at regular intervals in a direction orthogonal to the tube-axis direction and such that one of the outer lateral walls 1A, extending in the long-side direction, of each of the flat heat-transfer tubes 1 faces a corresponding one of the outer lateral walls 1A of an adjacent one of the flat heat-transfer tubes 1.

In the manufacture of the heat exchanger 10 according to Embodiment 1, the flat heat-transfer tubes 1 are fitted into receiving holes (not illustrated) provided in the headers 3 and are joined to the headers 3 by brazing. The brazing process employs a brazing alloy containing, for example, aluminum.

When the heat exchanger 10 is used as a condenser in the refrigeration cycle apparatus, high-temperature, high-pressure refrigerant is made to flow through the flow passages provided in the flat heat-transfer tubes 1. When the heat exchanger 10 is used as an evaporator, low-temperature, low-pressure refrigerant is made to flow through the flow passages provided in the flat heat-transfer tubes 1. The heat exchanger 10 is to be used as the indoor heat exchanger 110 or the outdoor heat exchanger 203 illustrated in FIG. 2.

The refrigerant flows into one of the headers 3 through a pipe (not illustrated) provided for supplying the refrigerant to the heat exchanger 10 from a device included in a refrigeration cycle, such as the four-way valve 202 or the expansion valve 120 included in the above air-conditioning apparatus 1000. The refrigerant received by one of the headers 3 is split into refrigerant portions that flow through the respective flat heat-transfer tubes 1. Each of the flat heat-transfer tubes 1 allows the refrigerant portion flowing thereinside to exchange heat with outdoor air, or outdoor atmosphere, flowing thereoutside. While the refrigerant portion flows through the flat heat-transfer tube 1, the refrigerant portion transfers heat to or takes away heat from the outdoor air. When the refrigerant portion has a higher temperature than the outdoor air, the refrigerant portion transfers its heat to the outdoor air. When the refrigerant portion has a lower temperature than the outdoor air, the refrigerant portion takes away heat from the outdoor air. The refrigerant portions having undergone heat exchange by flowing through the respective flat heat-transfer tubes 1 flow into the other header 3 and merge altogether. Then, the merged refrigerant flows through a pipe connected to the other header 3 and returns to an external apparatus.

Corrugated Fins 2

The corrugated fins 2 are each placed between the outer lateral walls 1A of adjacent ones of the plurality of flat heat-transfer tubes 1. The corrugated fins 2 are provided for increasing the area of heat transfer between the refrigerant and the outdoor air in the heat exchanger 10. Each corrugated fin 2 is obtained by corrugating a plate such that the plate is fanfolded to have mountain folds and valley folds alternately. In other words, as illustrated in FIG. 1 in front view, the corrugated fin 2 has a wavy or pleated shape. The folds in the corrugated fin 2 form the apexes of the waves. In Embodiment 1, the apexes of the corrugated fin 2 are aligned in the tube-axis direction along the outer lateral walls 1A of the flat heat-transfer tubes 1.

As illustrated in FIG. 3, the corrugated fin 2 includes a front edge part 2B, which is an end part that projects from between the outer lateral walls 1A, facing toward each other, of the adjacent flat heat-transfer tubes 1 and toward the upstream side in the direction of the airflow. The corrugated fin 2 excluding the front edge part 2B is in contact with the outer lateral walls 1A of the flat heat-transfer tubes 1 at the apexes, 2A, of the wavy shape thereof. The apexes 2A and the outer lateral walls 1A that are in contact with each other are joined to each other by brazing with a brazing alloy.

The plate serving as the corrugated fin 2 is made of, for example, an aluminum alloy. The plate is cladded with a brazing-alloy layer. Basically, the brazing-alloy layer used for the cladding is, for example, an alloy containing aluminum-silicon-based aluminum and is of about 30 μm to 200 μm.

Sloping portions of the wavy corrugated fin 2 that each extend between and connect adjacent ones of the apexes 2A are each referred to as a fin 21. The fin 21 has heat-transfer promoters 22 and frost-growing areas 23. The heat-transfer promoters 22 project upward from the surface of the fin 21. The heat-transfer promoters 22 in each fin 21 are arranged side by side in the depthwise direction coinciding with the direction of the airflow.

The heat-transfer promoters 22 each have a transfer-promoting projection 22A and an open part 22B. The transfer-promoting projection 22A projects in the tube-axis direction from the fin 21. The open part 22B allows air or condensed water to pass therethrough. The open part 22B is an opening provided immediately below the transfer-promoting projection 22A. In each fin 21, the frost-growing areas 23 are individually located adjacent to the heat-transfer promoters 22 in the depthwise direction. The frost-growing areas 23 are holes piercing through the fin 21. When viewed perpendicularly to the surface of the fin 21, the frost-growing areas 23 are each a rectangular hole that is oblong in the side-by-side direction of the plurality of flat heat-transfer tubes 1. The frost-growing areas 23 are individually located between the heat-transfer promoters 22 and flat parts 24. That is, each frost-growing area 23 is adjacent to one of the heat-transfer promoters 22 and to one of the flat parts 24. In other words, the fin 21 has a plurality of openings each of which is partially covered from above by a corresponding one of the transfer-promoting projections 22A. The plurality of openings individually adjoin the flat parts 24. The plurality of openings are side by side in the depthwise direction of the heat exchanger 10.

Functions of Heat-Transfer Promoters 22 and Frost-Growing Areas 23

When the heat exchanger 10 functions as an evaporator, the surfaces of the flat heat-transfer tubes 1 and the corrugated fins 2 have lower temperatures than the air flowing through the heat exchanger 10. Therefore, moisture in the air is condensed on the surfaces of the flat heat-transfer tubes 1 and the corrugated fins 2 to precipitate as condensed water 4. Moreover, when the air temperature is particularly low, the surface temperature of the corrugated fins 2 drops to below the freezing point of water. In such a case, the condensed water 4 built up on the surfaces of the corrugated fins 2 is frozen into frost. If such frost grows, the airflow passages are closed. Accordingly, the airflow resistance in the heat exchanger 10 increases, and the amount of air flowing through the heat exchanger 10 is reduced. Consequently, the performance of the heat exchanger 10 may be lowered.

In Embodiment 1, condensed water 4 precipitated on any of the fins 21 of the corrugated fins 2 flows into the open parts 22B of the heat-transfer promoters 22 and the frost-growing areas 23, and drops onto another fin 21 located below. The frost-growing areas 23 are continuous with the open parts 22B of the heat-transfer promoters 22. Therefore, openings of increased areas are provided. Accordingly, the amount of condensed water 4 to be retained on each fin 21 by the effect of surface tension is reduced, and the drainage speed is increased. Furthermore, the fins 21 of the corrugated fins 2 are each not parallel to but inclined relative to the side-by-side direction of the flat heat-transfer tubes 1. Therefore, condensed water is drained in such a manner as to flow along the inclined surfaces of the fins 21 and drop through the frost-growing areas 23. Thus, in the heat exchanger 10, the amount of condensed water 4 that may build up on the corrugated fins 2 is small, and the drainage speed is therefore increased.

Under a low-temperature condition where the surface temperature of the corrugated fins 2 is below the freezing point of water, moisture on the surfaces of the fins 21 is frozen and grows as frost. The growth of the frost is more pronounced at a location closer to the front edge part 2B of each fin 21, because the front edge part 2B is at the upstream end in the direction of the airflow supplied to the heat exchanger 10 and therefore has a high coefficient of heat transfer. If frost grows at the front edge part 2B, the airflow passage is narrowed, lowering the heat-exchanger performance. In Embodiment 1, however, one of the frost-growing areas 23 is designed to adjoin the front edge part 2B where frost tends to grow. Furthermore, the frost-growing areas 23 are designed to be continuous with the heat-transfer promoters 22 where frost tends to grow. Thus, the narrowing of the airflow passage is slowed. Consequently, the lowering in the heat-exchanger performance is suppressed. That is, the heat exchanger 10 having the frost-growing areas 23 exhibits improved frost resistance. At the windwardmost one of the heat-transfer promoters 22 of the heat exchanger 10, the temperature difference between the air and the surface of the fin is greater and the amount of frosting is therefore greater than at leeward ones of the heat-transfer promoters 22. Hence, providing the frost-growing areas 23 as in the fin 21 of the heat exchanger 10 according to Embodiment 1 suppresses the reduction in the drainage speed and enhances the effect of slowing the narrowing of the airflow passage.

Figure 4:
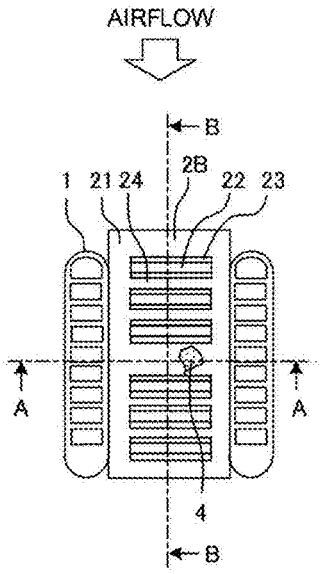
FIG. 4 is a top view of the corrugated fin 2 according to Embodiment 1.

FIG. 4 is a top view of the corrugated fin 2 according to Embodiment 1. In FIG. 4, the corrugated fin 2 is viewed in the tube-axis direction of the plurality of flat heat-transfer tubes 1. Line A-A given in FIG. 4 represents the depthwise center of the plurality of flat heat-transfer tubes 1. Line B-B given in FIG. 4 represents the midpoint between the two flat heat-transfer tubes 1 between which the corrugated fin 2 is placed. As described above, the frost-growing areas 23 are arranged with the heat-transfer promoters 22 interposed in between. Therefore, condensed water is drained downward through the frost-growing areas 23 provided on both sides of each heat-transfer promoter 22, where condensation tends to occur. Accordingly, the drainage is promoted. Under a low-temperature condition, since frost grows in the frost-growing areas 23 that are spaces on the two respective sides of each heat-transfer promoter 22, the frost is less likely to hinder the airflow passing through between the plurality of flat heat-transfer tubes 1. Accordingly, the frost resistance of the heat exchanger 10 is improved.

Figure 5:
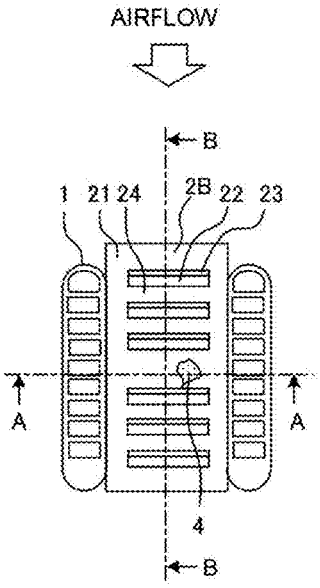
FIG. 5 is a top view of a fin 21 of a corrugated fin 2 according to a modification of Embodiment 1.

FIG. 5 is a top view of a fin 21 of a corrugated fin 2 according to a modification of Embodiment 1. The growth of the frost is more pronounced on those heat-transfer promoters 22 closer to the front edge part 2B, which is at the upstream end in the direction of the airflow and therefore has a high coefficient of heat transfer. Hence, for example, the frost-growing areas 23 may be provided only on the windward side of the respective heat-transfer promoters 22 as illustrated in FIG. 5. In such a modification, the frost-growing areas 23 in the form of holes provided in the fin 21 are located, in top view, only on the upstream side of the respective heat-transfer promoters 22. Therefore, the reduction in the area of heat transfer is suppressed, while the frost resistance is improved.

Figure 6:
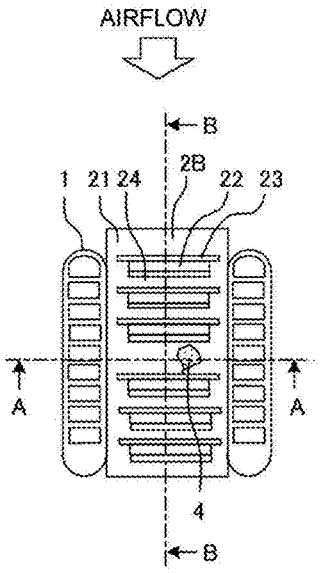
FIG. 6 is a top view of a corrugated fin 2 according to another modification of Embodiment 1.

FIG. 6 is a top view of a corrugated fin 2 according to another modification of Embodiment 1. While FIGS. 4 and 5 each illustrate an exemplary fin 21 in which the heat-transfer promoters 22 and the frost-growing areas 23 are of the same width and at the same position in the side-by-side direction of the flat heat-transfer tubes 1, the fin 21 is not limited thereto. For example, the width of the frost-growing areas 23 may be different from the width of the heat-transfer promoters 22. That is, the frost-growing areas 23 and the heat-transfer promoters 22 may only overlap each other in part in the depthwise direction. Alternatively, the centers of adjacent ones of the heat-transfer promoters 22 may be at different positions in the side-by-side direction.

To manufacture the corrugated fin 2, the following steps need to be performed: a step of providing through-holes 27 (see FIG. 16), which are to serve as the frost-growing areas 23; and a step of forming the transfer-promoting projections 22A of the heat-transfer promoters 22 that project from the surface of the fin 21. In the case of the fin 21 illustrated in FIG. 6, a die for punching the frost-growing areas 23 and a die for forming the heat-transfer promoters 22 need to be set at different positions in the widthwise direction and to be pressed against the fin 21. If the frost-growing areas 23 and the heat-transfer promoters 22 only overlap each other in part in the depthwise direction, a die for punching the frost-growing areas 23 and a die for forming the heat-transfer promoters 22 are set at different positions in the side-by-side direction of the flat heat-transfer tubes 1 and are pressed against the fin 21. If the two dies are at different positions in such a forming process, the fin 21 tends to warp. However, as long as the horizontal centers of the frost-growing areas 23 and the heat-transfer promoters 22 coincide with each other, the warping of the fin 21 that may occur in the forming process tends to be suppressed.

Figure 7:
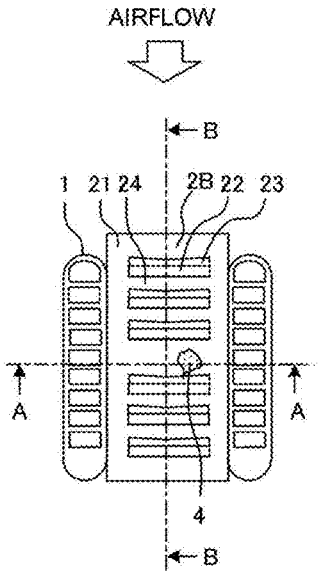
FIG. 7 is a top view of a fin 21 of a corrugated fin 2 according to still another modification of Embodiment 1.

FIG. 7 is a top view of a fin 21 of a corrugated fin 2 according to still another modification of Embodiment 1. While Embodiment 1 relates to a case where the frost-growing areas 23 each have a rectangular shape as illustrated in any of FIGS. 4 to 6, the frost-growing areas 23 are not limited to rectangular ones. For example, considering the distribution of frost growth that has been clarified through analyses and experiments conducted by the present inventors, the opening size of each of the frost-growing areas 23 in the depthwise direction is reduced in a direction away from the two flat heat-transfer tubes 1, as illustrated in FIG. 7. The frost-growing areas 23 illustrated in FIG. 7 are each shaped such that the opening size, or the opening area, in the depthwise direction is smaller in regions where the heat-exchanger effectiveness exerted by the fin 21 is lower. Thus, while the reduction in the area of heat transfer is suppressed in regions farther from the two flat heat-transfer tubes 1, the frost resistance is improved efficiently.

Figure 8:
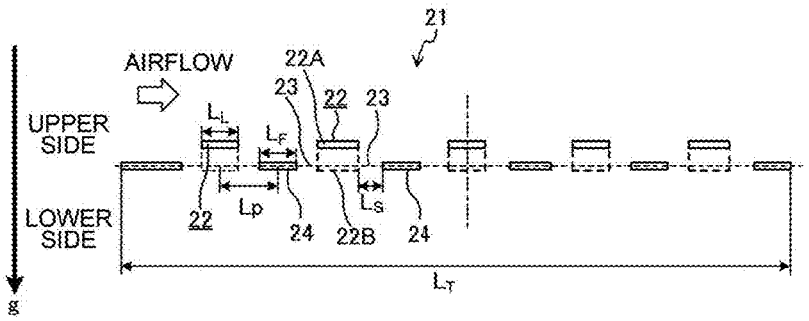
FIG. 8 illustrates a sectional configuration of the fin 21 according to Embodiment 1.

FIG. 8 illustrates a sectional configuration of the fin 21 according to Embodiment 1. FIG. 8 outlines the pattern of the fin 21 in a section perpendicular to the fin 21. The section corresponds to the section taken along line B-B in FIG. 4. As described above, the heat-transfer promoters 22 project from the surface of the fin 21 into the airflow passage for the outdoor air flowing through the heat exchanger 10. In such a configuration, the heat-transfer promoters 22 promote heat transfer by disturbing the thermal boundary layer of the air in the airflow passage provided between the two flat heat-transfer tubes 1.

The frost-growing areas 23 are arranged in such a manner as to be located, in the direction of the airflow, on the upstream side or on both the upstream side and the downstream side of the individual heat-transfer promoters 22. The frost-growing areas 23 are holes piercing through the fin 21. On the downstream side of each frost-growing area 23 is provided a corresponding one of the flat parts 24. On the downstream side of each flat part 24 is provided a corresponding one of the frost-growing areas 23. That is, the frost-growing areas 23 are provided on both the upstream side and the downstream side of the individual flat parts 24.

The frost-growing areas 23 are holes provided in the fin 21 and adjoin the individual heat-transfer promoters 22 at least on the upstream side of the heat-transfer promoters 22. The heat-transfer promoters 22 have the respective transfer-promoting projections 22A each formed by raising a part of the fin 21 upward relative to the flat parts 24. Below the transfer-promoting projections 22A are provided the respective open parts 22B. The frost-growing areas 23 are continuous with the open parts 22B provided below the heat-transfer promoters 22, thereby providing integrated openings. That is, the transfer-promoting projections 22A each extend over an opening provided in the fin 21.

Figure 9:
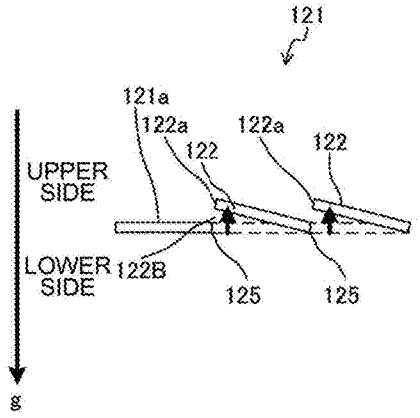
FIG. 9 illustrates a sectional configuration of a fin 121, a comparative example of the fin 21 according to Embodiment 1.

FIG. 9 illustrates a sectional configuration of a fin 121, a comparative example of the fin 21 according to Embodiment 1. The known heat exchanger includes louvers 122, which are obtained by cutting and slanting some parts of the fin 121. The known louvers 122 are formed by making incisions 125 in a flat plate that is to serve as a fin 21, and pressing the flat plate to raise some parts thereof such that the incisions 125 are widened in a direction perpendicular to the surface of the fin 21. Thus, openings 122B are provided between a flat part 121*a* and the front edges, 122*a*, of the louvers 122 in such a manner as to be open in the direction perpendicular to the flat part 121*a*. The front edges 122*a* are the windward edges of the louvers 122. When the known louvers 122 are viewed in the direction perpendicular to the flat part 121*a*, the openings 122B are invisible or only seen as slight gaps.

In contrast, as illustrated in any of FIGS. 4 to 7, when the fin 21 of the heat exchanger 10 according to Embodiment 1 is viewed in the direction perpendicular to the surface thereof, the frost-growing areas 23 are visible as openings. For example, the openings viewed in the direction perpendicular to the surface of the fin 21 each have a depthwise size of 0.5 mm or greater, desirably 1 mm or greater, and are each provided at least on the upstream side of a corresponding one of the heat-transfer promoters 22. That is, in Embodiment 1, the fin 21 includes no parts that are cut and slanted but has a configuration in which the transfer-promoting projections 22A of the heat-transfer promoters 22 and the frost-growing areas 23 in the form of holes are arranged side by side in the depthwise direction. Therefore, when the fin 21 is viewed in the tube-axis direction, the frost-growing areas 23 are visible as holes.

As illustrated in FIG. 8, in the airflow direction coinciding with the depthwise direction, the length of each of the frost-growing areas is denoted by $L_S$, the center distance between each of the heat-transfer promoters 22 and a corresponding one of the frost-growing areas 23 is denoted by $L_P$, the length of each of the heat-transfer promoters 22 is denoted by $L_L$, the length of each of the flat parts 24 is denoted by $L_F$, and the fin total length is denoted by $L_T$.

In the fin 21 of the heat exchanger 10 that is illustrated in FIG. 8, to improve the drainability in a defrosting operation while improving the frost resistance, the frost-growing area 23 may desirably be large enough relative to the heat-transfer promoter 22. Specifically, $L_S>L_L/7$, more desirably $L_S>L_L/6$, is preferable. If the length $L_S$ of the frost-growing area 23 and the length $L_L$ of the heat-transfer promoter 22 are set to respective values that meet the above relationship, high drainability at the frost-growing area 23 is achieved with improved frost resistance. Thus, improved frost resistance is achieved in the heat exchanger 10 serving as an evaporator under a low-temperature condition. Accordingly, the air-conditioning apparatus 1000 exerts improved low-temperature heating capacity.

Figure 10:
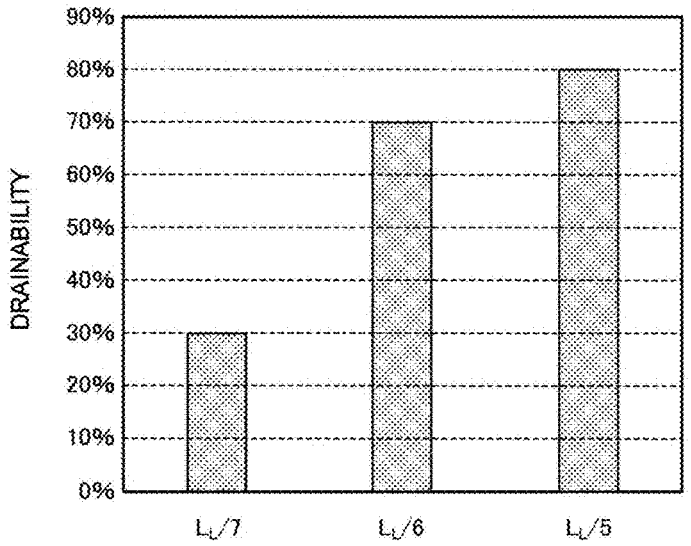
FIG. 10 illustrates a relationship between the width of frost-growing areas and drainability in the heat exchanger 10 according to Embodiment 1.

FIG. 10 illustrates a relationship between the width of the frost-growing area and drainability in the heat exchanger 10 according to Embodiment 1. FIG. 10 is a graph illustrating drainability versus $L_S$ of $L_F/5$ to $L_F/7$ and obtained as a result of a three-dimensional analysis of two-phase flow that has been developed by the present inventors. The drainability of the heat exchanger 10 was obtained as follows. The heat exchanger 10 was immersed in water in a tank and was pulled up. Then, the amount of water retained by the heat exchanger 10 was calculated at any given time points, and the results were compared. FIG. 10 shows that the higher the drainability, the faster the drainage speed.

As illustrated in FIG. 10, the drainability increases with the increase in the ratio of the depthwise length $S_L$ of the frost-growing area 23 relative to the depthwise length $L_L$ of the heat-transfer promoter 22. The drainability is particularly high when $L_S>L_L/7$. The reason for this is considered as follows. When the length $L_S$ of the frost-growing area 23 increases to a certain value, the probability that a water bridge may be formed between the flat part 24 and the heat-transfer promoter 22 by the effect of surface tension is reduced.

The depthwise length $L_S$ of the frost-growing area 23 may preferably be set to $L_L/6$ or greater. To obtain the fin 21 by roll forming, the plate that is to serve as the fin 21 needs to be rigid and strong to some extent. To meet such conditions for the corrugated fin 2 according to Embodiment 1, the length $L_S$ of the frost-growing area 23 may preferably be smaller than the length $L_F$ of the flat part 24. That is, the dimensions of the fin 21 according to Embodiment 1 may preferably satisfy $L_S \leq L_F$. Accordingly, the depthwise length of the frost-growing area 23 is set to meet $L_L/7<L_S \leq L_F$.

Furthermore, to improve the frost resistance of the heat exchanger 10 according to Embodiment 1, the frost-growing area needs to be large enough relative to the depthwise length $L_F$ of the flat part 24. Specifically, $L_S \geq L_F/4$, more desirably $L_S \geq L_F/3$, is preferable.

In Embodiment 1, since the fin 21 has the frost-growing areas 23, the sum total of the lengths $L_F$ of the flat parts and the lengths $L_L$ of the heat-transfer promoters is smaller than the fin total length $L_T$. That is, supposing that the heat-transfer promoters 22 and the flat parts 24 are arranged side by side at the same level, the length of such a fin 21 is shorter than the fin total length $L_T$ by the sum total of the lengths $L_S$ of the plurality of frost-growing areas 23.

Embodiment 2

A heat exchanger 10 according to Embodiment 2 will now be described. The heat exchanger 10 according to Embodiment 2 is different from the heat exchanger 10 according to Embodiment 1 in the shape of the heat-transfer promoters 22. The following description of Embodiment 2 focuses on the difference from Embodiment 1.

Figure 11:
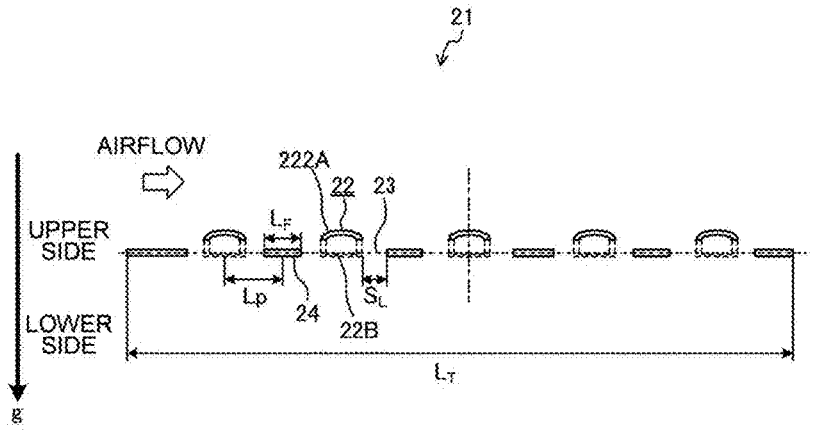
FIG. 11 illustrates an exemplary fin 21 according to Embodiment 2.

FIG. 11 illustrates an exemplary fin 21 according to Embodiment 2. Heat-transfer promoters 22 according to Embodiment 2 each include a transfer-promoting projection 222A, which projects from the surface of the fin 21 and has a top face that is not flat. In a section perpendicular to the side-by-side direction, the top face of the transfer-promoting projection 222A forms a curved surface in which a central part is convex upward. At the above-shaped top face of the transfer-promoting projection 222A of the heat-transfer promoter 22, condensed water 4 is less likely to build up. Thus, the drainability is improved. Furthermore, the curved surface at the top of the transfer-promoting projection 22A promotes the turbulence of the air flowing therealong through the heat exchanger 10. Thus, the performance of heat exchange is improved.

Embodiment 3

A heat exchanger 10 according to Embodiment 3 will now be described. The heat exchanger 10 according to Embodiment 3 is different from the heat exchanger 10 according to Embodiment 1 in the shape of the heat-transfer promoters 22. The following description of Embodiment 3 focuses on the difference from Embodiment 1.

Figure 12:
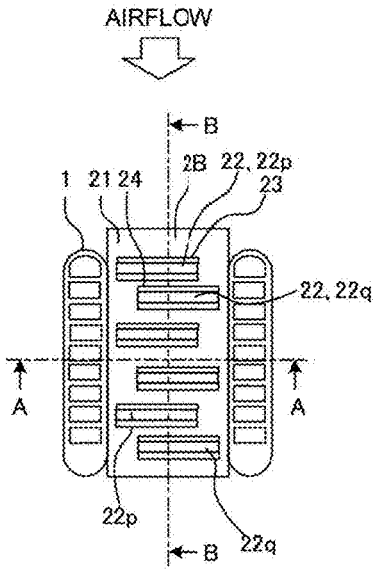
FIG. 12 illustrates an exemplary fin 21 according to Embodiment 3.

FIG. 12 illustrates an exemplary fin 21 according to Embodiment 3. In Embodiment 3, adjacent ones of the heat-transfer promoters 22, namely heat-transfer promoters 22*p* and 22*q* illustrated in FIG. 12, are at different positions in the side-by-side direction of the flat heat-transfer tubes 1. In such an arrangement, the front-edge effect produced at the front edges of the heat-transfer promoters 22 is enhanced. Specifically, while the heat-exchanger effectiveness exerted by the fin 21 is greater on the upstream side of the airflow, where frost is more likely to generate, the drainability of the heat-transfer promoters 22 is higher at the front edges thereof. Hence, even if frost is generated at the front edges of the heat-transfer promoters 22, the ease of air passage is less likely to be reduced. Since the pressure loss is thus reduced, the heat-exchanger performance is improved. Furthermore, the effect of improving the frost resistance at the frost-growing areas 23 is particularly pronounced in a configuration such as the one employed in Embodiment 3 in which the front-edge effect is enhanced.

Embodiment 4

A heat exchanger 10 according to Embodiment 4 will now be described. The heat exchanger 10 according to Embodiment 4 is different from the heat exchanger 10 according to Embodiment 1 in the shape of the heat-transfer promoters 22. The following description of Embodiment 4 focuses on the difference from Embodiment 1.

Figure 13:
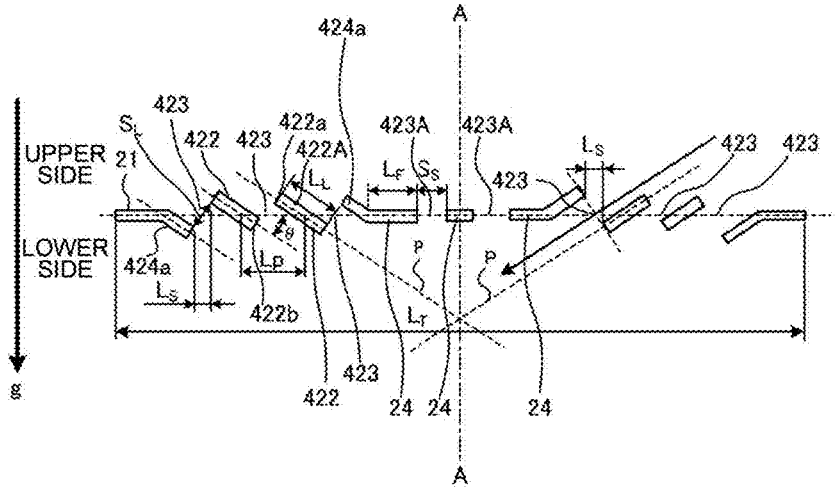
FIG. 13 illustrates an exemplary sectional shape of a fin 21 according to Embodiment 4.

FIG. 13 illustrates an exemplary sectional shape of a fin 21 according to Embodiment 4. In Embodiment 4, the heat-transfer promoters 22 and the flat parts 24 are changed to have inclined surfaces, forming so-called louvers. Specifically, Embodiment 4 employs heat-transfer promoters 422, which each include an inclined heat-transfer projection 422A. In the heat-transfer projection 422A, one depthwise end 422*a* is located higher than the flat parts 24, whereas another depthwise end 422*b* is located lower than the flat parts 24. Alternatively, the ends 422*a* and 422*b* of the heat-transfer projection 422A may be at the same level as the flat parts 24.

A frost-growing area 423 is provided on each of the upstream side and the downstream side of each heat-transfer promoter 422. As with the frost-growing area 23 of the fin 21 in any of Embodiments 1 to 3, when viewed in the direction perpendicular to the surface of the fin 21, the frost-growing area 423 has a depthwise opening size of 0.5 mm or greater, desirably 1 mm or greater.

The known corrugated fin illustrated in FIG. 9 includes the louvers 122 that are formed by making the incisions 125 in the fin 121. In contrast, the fin 21 according to Embodiment 4 includes the frost-growing areas 423 in the form of holes, whereby increased intervals are provided between the heat-transfer projections 422A of the heat-transfer promoters 422. That is, increased spaces are provided between the louvers. Thus, while heat transfer is promoted, improved condensed-water drainability and improved frost resistance are achieved.

In the fin 121 including the louvers 122, which exert a great effect of heat-transfer promotion, the growth of the frost is pronounced at the front edges 122*a* located between adjacent louvers 122, that is, at upstream parts of the louvers 122. Consequently, the airflow passage is narrowed, which lowers the heat-exchanger performance under a low-temperature condition. On the other hand, in the heat exchanger, 410, according to Embodiment 4, the frost-growing areas 423 each have a depthwise length $L_S$ in the section illustrated in FIG. 13. Furthermore, the upstream end 422*a* of one of two heat-transfer promoters 422 that are adjacent to each other in the depthwise direction and the downstream end 422*b* of the other of the two heat-transfer promoters 422 are at a distance $L_S$ in the depthwise direction. That is, a wide space for frost to grow is provided at each of the upstream ends 422*a* of the heat-transfer promoters 422 where the growth of the frost is pronounced. Thus, the narrowing of the airflow passage is suppressed.

The fin 21 may have flat parts 24 near the depthwise center thereof. On the upstream side or the downstream side of each of the flat parts 24 is provided a frost-growing area 423A, which is intended to improve drainability and has a depthwise length $L_S$. Since the frost-growing areas 423A are also provided near the depthwise center of the fin 21, the drainability is further improved.

In the fin 21 according to Embodiment 4, the heat-transfer promoters 422 have slopes. If the angle of such louvers is set to 0 degrees, the following relationship is satisfied: (total depthwise length $L_T$ of fin 21—sum total of depthwise lengths $L_S$ of frost-growing areas 23)>(sum total of lengths $L_L$ of slopes+sum total of lengths $L_F$ of flat parts). Furthermore, the heat-transfer promoters 422 in the form of louvers are arranged in a symmetrical pattern with reference to the depthwise center. Specifically, the heat-transfer promoters 422 are provided on both sides relative to the frost-growing areas 423A adjoining the flat parts 24 near the center, and those heat-transfer promoters 422 on one side and those heat-transfer promoters 422 on the other side are oriented to face toward each other.

In FIG. 13, when the thicknesswise center lines of two heat-transfer promoters 422 that are in symmetrical positions with reference to the center are extended and defined as virtual lines P, the inclinations of the heat-transfer promoters 422 are set such that the virtual lines P intersect each other at a position below the fin 21. In such a configuration, condensed water flows along the heat-transfer promoters 422 and gathers around the center of the fin 21. The gathering of condensed water occurs around the center of each of the plurality of fins 21 arranged side by side in the top-bottom direction. Therefore, the condensed water is efficiently guided to the frost-growing areas 423A located around the flat parts 24. Thus, the drainability of the heat exchanger 10 is improved. While Embodiment 4 relates to a case where a plurality of flat parts 24 and a plurality of frost-growing areas 423A are provided, the numbers and the shapes of the flat parts 24 and the frost-growing areas 423A are not limited.

Each flat part 24 located adjacent to the heat-transfer promoter 422 with a corresponding one of the frost-growing areas 423 interposed in between may include a slope 424*a* at an end thereof closer to the frost-growing area 423. The slope 424*a* may preferably be angled and oriented conforming to the inclination of the heat-transfer promoters 422.

Embodiment 5

A heat exchanger 10 according to Embodiment 5 will now be described. Embodiment 5 relates to an exemplary method of manufacturing the fins 21 of the heat exchanger 10 according to any of Embodiments 1 to 4.

Figure 14:
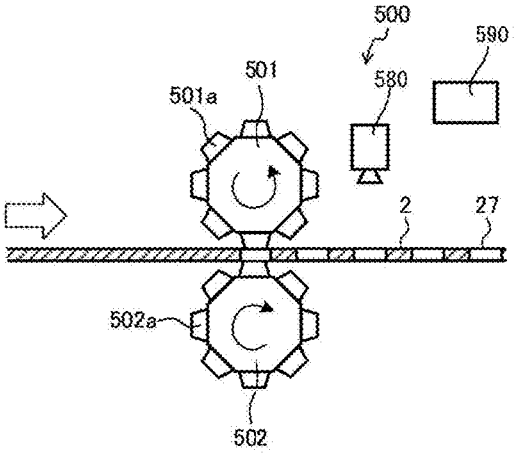
FIG. 14 illustrates an apparatus according to Embodiment 5 that is configured to manufacture the corrugated fins 2.

FIG. 14 illustrates an apparatus according to Embodiment 5 that is configured to manufacture the corrugated fins 2. Specifically, FIG. 14 illustrates an exemplary punching roller 500, which is intended to manufacture the corrugated fins 2 according to any of Embodiments 1 to 4. The punching roller 500 is configured to form frost-growing areas 23 by making through-holes 27 (see FIG. 16) in a plate 521 (see FIG. 16), which is to serve as the corrugated fins 2. The plate 512 that is to serve as the corrugated fins 2 is supplied in between a first roller cutter 501 and a second roller cutter 502, which are positioned on the two respective sides in the top-bottom direction. When the rollers are mated with each other, the plate 521 is punched to have through-holes 27, which are to serve as the frost-growing areas 23.

The first roller cutter 501 and the second roller cutter 502 have respective rotation axes that extend parallel to each other. The first roller cutter 501 and the second roller cutter 502 have on the outer peripheries thereof cutters 501*a* and cutters 502*a*, respectively, with which the plate 521 is to be processed. The rotation axes of the first roller cutter 501 and the second roller cutter 502 are at a predetermined distance from each other. When the plate 521 is passed through between each of the cutters 501*a* and a corresponding one of the cutters 502*a*, the plate is punched or bent. The first roller cutter 501 and the second roller cutter 502 illustrated in FIG. 14 are configured to form the frost-growing areas 23 by, for example, punching.

If the pitches of the cutters 501*a* and 502*a* of the first roller cutter 501 and the second roller cutter 502 in the direction of rotation are changed, the resulting frost-growing areas 23 formed in the plate are at the changed intervals in the horizontal direction. For each of the first roller cutter 501 and the second roller cutter 502, one revolution is regarded as one period. Therefore, any changes in the intervals between the resulting through-holes 27 are periodical and regular.

For example, if the perimeter of each roller is made longer than the length of the corrugated fin 2 to be obtained, the intervals between the frost-growing areas 23 to be obtained is varied among different corrugated fins 2. Since the frost-growing areas 23 of the corrugated fins 2 are formed by using the punching roller 500, the processing speed in the manufacture of the corrugated fins 2 is faster than in the case of normal pressing. As illustrated in FIG. 14, the apparatus configured to manufacture the corrugated fins 2 includes a controller 590. The controller 590 is configured to control processing conditions including the rotation speeds of the first roller cutter 501 and the second roller cutter 502 and the speed of feeding of the plate 521.

Figure 15:
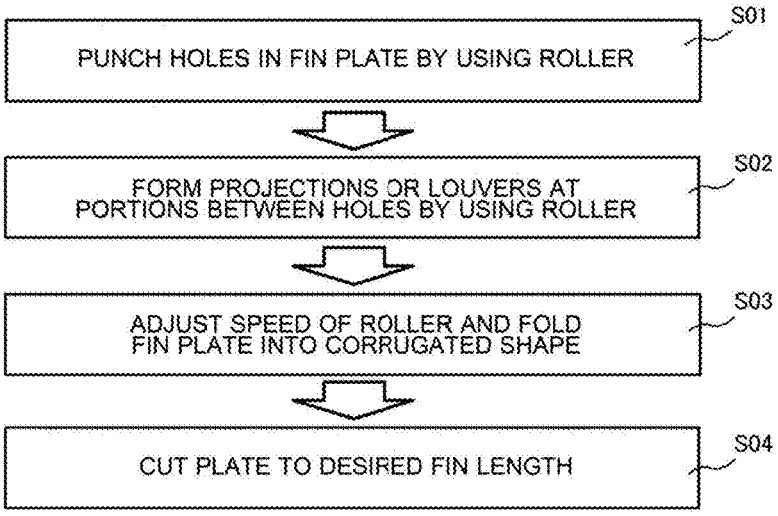
FIG. 15 illustrates an exemplary flow of processing steps according to Embodiment 5 that are performed for obtaining the corrugated fins 2.

FIG. 15 illustrates an exemplary flow of processing steps according to Embodiment 5 that are performed for obtaining the corrugated fins 2. First, through-holes 27 are provided in a plate 521 that is to serve as the corrugated fins 2 (step S01). The through-holes 27 are punched by, for example, the punching roller 500 illustrated in FIG. 14. This step is referred to as the punching step. With reference to the through-holes 27, heat-transfer promoters 422 are formed by forming, for example, projections or louvers in respective flat portions that are located between the frost-growing areas 23 (step S02). This step is referred to as the transfer-promoter-forming step. Subsequently, the plate that is to serve as the corrugated fins 2 is folded into a wavy shape (step S03). This step is referred to as the folding step. Subsequently, the folded plate is cut into pieces each adjusted to have a desired length (step S04).

Figure 16:
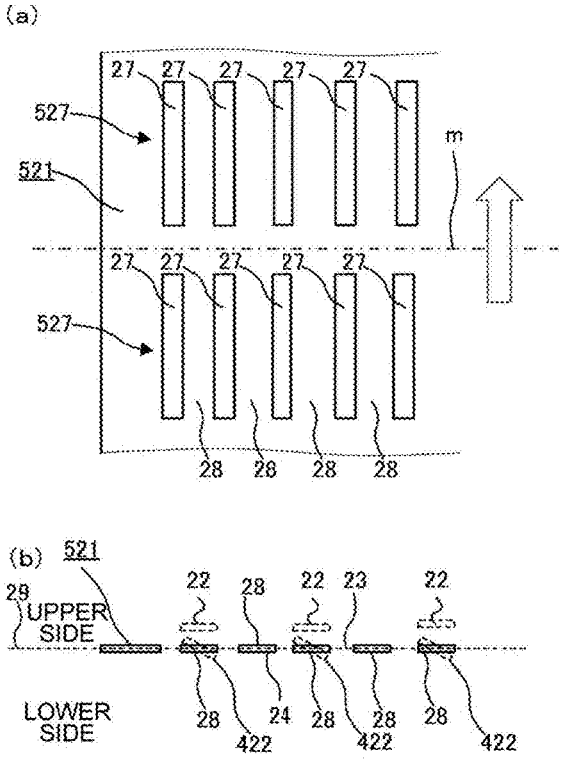
FIG. 16 illustrates one of the processing steps according to Embodiment 5 that are performed for obtaining the corrugated fins 2.

FIG. 16 illustrates one of the processing steps according to Embodiment 5 that are performed for obtaining the corrugated fins 2. In step S01, a flat plate 521 that is to serve as the corrugated fins 2 is punched to have through-holes 27, which are to serve as the frost-growing areas 23 and each have an oblong rectangular shape or substantially rectangular shape. Referring to FIG. 16, the plate 521 is a strip of metal plate that extends in a direction indicated by the white arrow illustrated in FIG. 16. The through-holes 27 are punched in the plate 521 in units of through-hole groups 527, in each of which the through-holes 27 are arrayed side by side with reference to the long-side direction thereof. The through-hole groups 527 are punched successively in the long-side direction (the direction indicated by the white arrow in FIG. 16) of the plate 521.

In step S02, at least one of flat portions 28, which define the two longer edges of each oblong rectangular through-hole 27, is deformed in such a manner as to be moved in the direction perpendicular to the surface of the plate 521 from the original position, 29, whereby the heat-transfer promoters 22 illustrated in sectional view in FIG. 9 or 10 are obtained. That is, the flat portions 28 between the through-holes 27 that are parallel to one another are each deformed into a bridge shape (also referred to as a bridge lance) that is raised in the direction perpendicular to the surface of the plate 521. Alternatively, the flat portions defining the longer edges of the slits may be deformed to incline relative to the original position 29, whereby louvers such as the heat-transfer promoters 22 illustrated in FIG. 13 may be obtained.

The forming in step S02 may be performed with a roller such as the one illustrated in FIG. 13. Specifically, the heat-transfer promoters 22 may be formed by passing the plate 521 having the through-holes 27 through between two rollers. The roller for forming the heat-transfer promoters 22 is set at, for example, a position downstream of the punching roller 500 illustrated in FIG. 14 so that the plate 521 exited from the punching roller 500 illustrated in FIG. 14 is successively fed to the forming roller.

The step of punching the through-holes 27 (step S01) and the step of deforming the flat portions 28 between the through-holes 27 into bridge shapes by raising the flat portions 28 in the direction perpendicular thereto (step S02) may be integrated into a single step. For example, the punching roller 500 illustrated in FIG. 14 may be used for simultaneously forming the through-holes 27 and the heat-transfer promoters 22.

After the completion of the punching and deforming of the plate 521 in step S01 and step S02, the plate 521 is folded along a line m, illustrated in FIG. 16(*a*). The plate 521 is fed in the direction of the white arrow illustrated in FIG. 16(*a*) and is folded along each of the lines m (step S03). The lines m are virtual lines given between adjacent ones of the successive rows of the through-holes 27. The plate 521 thus folded is then cut into pieces each having a predetermined length, whereby the corrugated fins 2 are obtained (step S04).

The corrugated fins 2 obtained as above are placed between the flat heat-transfer tubes 1, and the apexes 2A of the wavy corrugated fins 2 are joined to the outer lateral walls 1A of the flat heat-transfer tubes by brazing or any other method. Furthermore, the two ends of each of the flat heat-transfer tubes 1 are fitted into the insertion holes provided in the headers 3A and 3B and are joined to the headers 3A and 3B by brazing. Thus, the heat exchanger 10 is complete.

In the method of manufacturing the heat exchanger 10 according to Embodiment 5, the corrugated fins 2 are obtained through successive and accurate forming of the through-holes 27 and the heat-transfer promoters 22. Therefore, easy and fast manufacture of the corrugated fins 2 according to Embodiments 1 to 4 is achieved.

In the known art, it is difficult to successively form the through-holes 27 and the heat-transfer promoters 22. Specifically, for example, in the case of the fin 121 taken as the comparative example, incisions 125 are made in a plate and are then widened in the direction perpendicular to the surface of the plate, whereby louvers 122 and openings 122B are obtained. Such a corrugated fin 2 including the fin 121 is of low drainability and low frost resistance. In contrast, in the method of manufacturing the heat exchanger 10 according to Embodiment 5, the through-holes 27 and the heat-transfer promoters 22 are formed synchronously and accurately such that the frost-growing areas 23 each adjoin, in the airflow direction along the corrugated fin 2, at least one end of a corresponding one of the heat-transfer promoters 22. Thus, the configurations of the fins 21 each including the frost-growing areas 23 as described in Embodiments 1 to 4 have been realized.

An exemplary method of the above synchronization employs an image capturing device 580, such as a CCD camera, illustrated in FIG. 14. Specifically, an image captured through the CCD camera is processed, and the positions of the through-holes 27 obtained and variations in the positions of the through-holes 27 obtained are monitored. While the positions of the through-holes 27 obtained and variations in the positions of the through-holes 27 obtained are monitored, the speed of material feeding and the speed of rotation of the roller 500 are adjusted such that the through-holes 27 and the heat-transfer promoters 22 are formed successively. Alternatively, information on the positions of the through-holes 27 in the captured image, processing conditions including the speed of material feeding and the speed of rotation of the roller 500, and data on the accuracy in the shape of the heat-transfer promoters 22 may be collected as a set of teaching data for mechanical learning using AI so that the timings of adjusting the processing conditions including the speed of material feeding and the speed of rotation of the roller 500 can be optimized.

In the method of manufacturing the heat exchanger 10, the punching step and the transfer-promoter-forming step are performed successively. Therefore, depending on the degree of variations in the speed of material feeding and the speed of rotation of the roller 500, the positions of the through-holes 27 obtained in the punching step may vary, and the position of the heat-transfer promoters 22 obtained in the transfer-promoter-forming step may vary. Consequently, the heat-transfer promoters 22 may be displaced relative to the through-holes 27. In particular, since the material is fed to the subsequent step in one direction and at a preset speed, the positions of the through-holes 27 and the shapes and positions of the heat-transfer promoters 22 processed as above tend to vary in the direction of material feeding.

In view of the above, for example, a CCD camera is provided between the site for the punching step and the site for the transfer-promoter-forming step, and an image of the surface of the material in which the through-holes 27 have been punched is captured. Furthermore, another CCD camera is provided next to the site for the transfer-promoter-forming step, and an image of the surface of the material in which the heat-transfer promoters 22 have been formed is captured. The images captured by the CCD cameras are processed. Furthermore, position-accuracy data, for example, representing information such as the displacements between the through-holes 27 and the heat-transfer promoters 22 is acquired. The position-accuracy data is combined with the information on the processing conditions including the speed of material feeding and the speed of rotation of the roller 500 into labeled data to be mechanically learned by a model. Furthermore, information on processing conditions other than the speed of material feeding and the speed of rotation of the roller 500, namely processing conditions including the thickness of the plate 521 and the temperature, may be added to the labeled data to be mechanically learned by the model.

In the punching step and the transfer-promoter-forming step, the model acquires the displacements between the through-holes 27 and the heat-transfer promoters 22 from the actual images captured by the CCD cameras, and adjusts the processing conditions including the speed of material feeding and the speed of rotation of the roller 500 based on the displacements acquired. Details of the adjustment are determined by AI with reference to the above mechanical learning. In the mechanical learning, the processing-accuracy data and the processing conditions based on the images captured during the punching step and the transfer-promoter-forming step may be provided as a feedback to the model to be reflected in the two steps while the steps are underway.

The model may be implemented by, for example, the controller 590 of the apparatus configured to manufacture the corrugated fins 2 or an electronic computer connected to the apparatus. The model determines appropriate processing conditions with reference to the data, including the actual processing conditions and images, acquired during the punching step and the transfer-promoter-forming step. Information on the processing conditions determined to be optimum by the model is transmitted as an instruction from the controller 590 to the roller 500 of the apparatus configured to manufacture the corrugated fins 2 and to the device configured to perform the transfer-promoter-forming step. Thus, the processing conditions are controlled. In response to the determination of the optimum processing conditions that has been made by the model, the controller 590 may constantly monitor and control the processing conditions, or may adjust the processing conditions at predetermined time intervals.

Embodiments 1 to 5 of the present disclosure that have been described above each relate to only an exemplary heat exchanger 10, an exemplary refrigeration cycle apparatus, or an exemplary method for manufacturing a heat exchanger. Embodiments 1 to 5 may each be combined with any other known techniques. Furthermore, some of the elements of the heat exchanger 10 may be omitted or changed within the scope of the present disclosure.

In each of the heat exchangers 10 according to Embodiments 1 to 5, it is desirable that the frost-growing areas 23 and the heat-transfer promoters 22 provided in the fin 21 be arranged in a symmetrical pattern with reference to the center of the fin 21 in the airflow direction, that is, the depthwise direction. In other words, the fin 21 may desirably have a symmetrical shape with reference to line A-A given in any of FIGS. 4 to 7 and FIG. 12. Arranging the frost-growing areas 23 and the heat-transfer promoters 22 in bilateral symmetry with reference to the center line makes it easy to straightly feed the plate 521 in the punching step and in the transfer-promoter-forming step. Therefore, the plate 521 is less likely to be displaced laterally relative to the direction of material feeding. Consequently, accurate forming of the through-holes 27 and the heat-transfer promoters 22 is achieved.

REFERENCE SIGNS LIST

1: flat heat-transfer tube, 1A: outer lateral wall, 1B: hole, 2: corrugated fin, 2A: apex, 2B: front edge part, 3: header, 3A: header, 3B: header, 4: condensed water, 10: heat exchanger, 21: fin, 21A: front surface, 22: heat-transfer promoter, 22A: transfer-promoting projection, 22B: open part, 22*p*: heat-transfer promoter, 22*q*: heat-transfer promoter, 23: frost-growing area, 24: flat part, 27: through-hole, 28: flat portion, 100: indoor unit, 110: indoor heat exchanger, 120: expansion valve, 121: fin, 121*a*: flat part, 122: louver, 122B: opening, 122*a*: front edge, 125: incision, 130: indoor fan, 200: outdoor unit, 201: compressor, 202: four-way valve, 203: outdoor heat exchanger, 204: outdoor fan, 210: heat exchanger, 222A: transfer-promoting projection, 300: gas refrigerant pipe, 310: heat exchanger, 400: liquid refrigerant pipe, 410: heat exchanger, 422: heat-transfer promoter, 422A: heat-transfer projection, 422*a*: upstream end, 422*b*: downstream end, 422*c*: end, 422*d*: (other) end, 423: frost-growing area, 423A: frost-growing area, 500: roller, 501: first roller cutter, 501*a*: cutter, 502: second roller cutter, 502*a*: cutter, 510: heat exchanger, 521: plate, 527: through-hole group, 580: image capturing device, 590: controller, 1000: air-conditioning apparatus

The invention claimed is:

1. A heat exchanger comprising:

a plurality of flat heat-transfer tubes arranged side by side such that an outer lateral wall of each of the flat heat-transfer tubes faces an outer lateral wall of an adjacent one of the flat heat-transfer tubes; and a corrugated fin having a wavy shape and provided between each adjacent two of the plurality of flat heat-transfer tubes, wherein the corrugated fin is joined to the outer lateral walls of each adjacent two of the plurality of flat heat-transfer tubes at apexes of the wavy shape, wherein the corrugated fin includes fins connecting the apexes and being side by side in an axial direction of the plurality of flat heat-transfer tubes, wherein defining a direction in which the plurality of flat heat-transfer tubes are side by side as a side-by-side direction and a longitudinal direction of a cross section of each of the plurality of flat heat-transfer tubes as a depthwise direction, the fin has a plurality of heat-transfer promoters arranged side by side in the depthwise direction, wherein the plurality of heat-transfer promoters each have a transfer-promoting projection projecting from a surface of the fin; and an open part provided in the fin, wherein the fin has, between the plurality of heat-transfer promoters, frost-growing areas whose width is defined in the depthwise direction, wherein the frost-growing areas each have a through-hole continuous with the open part of a corresponding one of the plurality of heat-transfer promoters, and wherein the through-hole is a hole formed by punching the corrugated fin.

2. The heat exchanger of claim 1, wherein the plurality of heat-transfer promoters each have a top face located at a top in a direction in which the heat-transfer promoter projects from the surface of the fin, and wherein the top face has a curved surface in which a depthwise central part is convex upward.

3. The heat exchanger of claim 1, wherein the plurality of heat-transfer promoters each have a top face located at a top in a direction in which the heat-transfer promoter projects from the surface of the fin, and wherein the top face is inclined relative to the surface of the fin.

4. The heat exchanger of claim 3, further comprising a flat part provided adjacent to one of the plurality of heat-transfer promoters with a corresponding one of the frost-growing areas interposed in between, and wherein the flat part includes a slope that is angled and oriented conforming to the top faces of the plurality of heat-transfer promoters.

5. The heat exchanger of claim 1, wherein each adjacent two of the plurality of heat-transfer promoters are at different positions in the side-by-side direction.

6. The heat exchanger of claim 1, wherein the fin satisfies a relationship of $L_L/7<L_S$, where $L_S$ denotes a depthwise length of each of the frost-growing areas, and $L_L$ denotes a depthwise length of each of the heat-transfer promoters.

7. The heat exchanger of claim 1, further comprising a flat part provided between each adjacent two of the plurality of heat-transfer promoters.

8. The heat exchanger of claim 7, wherein the fin satisfies a relationship of $L_L/7<L_S\leq L_F$, where $L_S$ denotes a depthwise length of each of the frost-growing areas, $L_L$ denotes a depthwise length of each of the heat-transfer promoters, and $L_F$ denotes a depthwise length of each of the flat parts.

9. A refrigeration cycle apparatus comprising the heat exchanger of claim 1.

10. The heat exchanger of claim 1, wherein the through-hole adjoins a downstream end of the transfer-promoting projection of the corresponding one of the plurality of heat-transfer promoters in the depthwise direction.

11. The heat exchanger of claim 1, wherein the fin has a flat part provided upstream of the plurality of heat-transfer promoters in the depthwise direction and a flat part provided downstream of the plurality of heat-transfer promoters in the depthwise direction.

12. A method for manufacturing a heat exchanger, the heat exchanger comprising:

a plurality of flat heat-transfer tubes arranged side by side such that an outer lateral wall of each of the flat heat-transfer tubes faces an outer lateral wall of an adjacent one of the flat heat- transfer tubes; and a corrugated fin having a wavy shape and provided between each adjacent two of the plurality of flat heat-transfer tubes, wherein the corrugated fin is joined to the outer lateral walls of each adjacent two of the plurality of flat heat-transfer tubes at apexes of the wavy shape, wherein the corrugated fin includes fins connecting the apexes and being side by side in an axial direction of the plurality of flat heat-transfer tubes, wherein defining a direction in which the plurality of flat heat-transfer tubes are side by side as a side-by-side direction and a longitudinal direction of a cross section of each of the plurality of flat heat-transfer tubes as a depthwise direction, the fin has a plurality of heat-transfer promoters arranged side by side in the depthwise direction, wherein the plurality of heat-transfer promoters each have a transfer-promoting projection projecting from a surface of the fin and an open part provided in the fin, wherein the fin has, between the plurality of heat-transfer promoters, frost-growing areas whose width is defined in the depthwise direction, wherein the frost-growing areas each have a through-hole continuous with the open part of a corresponding one of the plurality of heat-transfer promoters, the method comprising:

forming the corrugated fin from a flat plate; and joining the apexes of the corrugated fin to the flat heat-transfer tubes, and wherein the forming of the corrugated fin includes:

punching the through-holes in the plate and forming the heat-transfer promoters by deforming at least one of flat portions at edges of each of the through-holes such that the at least one flat portion is moved in a direction perpendicular to a surface of the plate;

folding the plate having the through-holes and the heat-transfer promoters into a wavy shape; and cutting the plate into pieces each having a predetermined length, the cutting being performed after the folding.

13. The method of claim 12, wherein the punching is performed by passing the plate through between two roller cutters each including a cutter, the two roller cutters having respective rotation axes that extend parallel to each other, wherein the forming of the heat-transfer promoters is performed after the punching and by passing the plate through between two rollers having respective rotation axes that extend parallel to each other.

14. The method of claim 13, wherein position accuracy of the through-holes made in the punching is monitored through an image of the surface of the plate, the image being captured by an image capturing device; and processing conditions including speeds of rotation of the roller cutters and a speed of feeding of the plate are varied based on data on the position accuracy of the through-holes, the data being acquired through the image.

15. The method of claim 14, wherein the processing conditions are varied based on a model generated on the basis of machine learning, and the data on the position accuracy of the through-holes is provided as feedback to the model.

* * * * *